US006002744A

United States Patent [19]

Hertz et al.

[11] Patent Number: 6,002,744

[45] Date of Patent: Dec. 14, 1999

[54] METHOD AND APPARATUS FOR GENERATING X-RAY OR EUV RADIATION

[75] Inventors: Hans M. Hertz, Stocksund; Lars Malmqvist, Lund; Lars Rymell, Stockholm; Magnus Berglund, Lund, all of Sweden

[73] Assignee: Jettec AB, Lund, Sweden

[21] Appl. No.: 09/175,953

[22] Filed: Oct. 21, 1998

Related U.S. Application Data

[63] Continuation of application No. PCT/SE97/00697, Apr. 25, 1997.

[30] Foreign Application Priority Data

Apr. 25, 1996 [SE] Sweden ..... 9601547

[51] Int. Cl.[6] ..... H01J 35/00

[52] U.S. Cl. ..... 378/119; 378/210

[58] Field of Search ..... 378/119

[56] References Cited

U.S. PATENT DOCUMENTS

| | | | |
|---|---|---|---|
| 3,416,153 | 12/1968 | Hertz et al. . | |
| 4,161,436 | 7/1979 | Gould . | |
| 4,317,994 | 3/1982 | Mallozzi | 378/119 |
| 4,866,517 | 9/1989 | Mochizuki et al. . | |
| 4,953,191 | 8/1990 | Smither et al. . | |
| 5,459,771 | 10/1995 | Richardson et al. . | |
| 5,577,092 | 11/1996 | Kublak et al. . | |

FOREIGN PATENT DOCUMENTS

| | | |
|---|---|---|
| 018649181 | 6/1992 | European Pat. Off. . |
| WO94/26080 | 11/1994 | WIPO . |

OTHER PUBLICATIONS

Leon J. Radziemski and David A. Cremers, "Laser–Induced Plasmas and Applications", New York and Basel, pp. 295–313.

"X–Ray Lithography, Where it is Now, and Where it is Going", Juan R. Maldonado, *Journal of Electronic Materials,* vol. 19, No. 7, 1990, pp. 699–709.

"Droplet target for low–debris laser–plasma soft X–ray generation", L. Rymell and H.M. Hertz, *Optics Communication,* vol. 103, 1990, pp. 105–110.

"Ink–Jet Printing", J. Heinzl, *Advances in Electronics and Electron Physics,* vol. 65, pp. 91–171.

"Debris–free soft x–ray generation using a liquid droplet laser–plasma target" H.M. Hertz et al., *Applications of Laser Plasma Radiation II,* Society of Photo–Optical Instrumentation Engineers, vol. 2523, 1995, pp. 88–93.

"Debris–free single–line laser–plasma x–ray source for microscopy", L. Rymell et al. *Appl. Phys. Lett.* 66 (20), May 15, 1995, pp. 2625–2627.

*Primary Examiner*—Craig E Church

*Attorney, Agent, or Firm*—Burns, Doane, Swecker & Mathis, L.L.P.

[57] ABSTRACT

A method for generating X- or EUV-radiation via laser plasma emission, in which at least one target (17) is generated in a chamber, and at least one pulsed laser beam (3) is focused on the target in the chamber. The target is generated in the form of a jet (17) of a liquid, and the laser beam (3) is focused on a spatially continuous portion of the jet (17). An apparatus for generating X- or EUV-radiation via laser plasma emission according to the method comprises a means for generating at least one laser beam (3), a chamber, a means (10) for generating at least one target (17) in the chamber, and a means (13) for focusing the laser beam (3) on the target (17) in the chamber (8). The target-generating means (10) is adapted to generate a jet (17) of a liquid. The focusing means (13) is adapted to focus the laser beam (3) on a spatially continuous portion of the jet (17).

20 Claims, 2 Drawing Sheets

METHOD AND APPARATUS FOR GENERATING X-RAY OR EUV RADIATION

This is a continuation of International Application No. PCT/SE97/00697, filed Apr. 25, 1997, that designates the United States of America.

The present invention generally relates to a method and an apparatus for generating X-ray or EUV radiation via laser plasma interaction with a target in a chamber. By focusing a pulsed laser on said target, an intensive X-ray source is obtained. This source can be used for e.g. lithography, microscopy, materials science or in some other X-ray application.

BACKGROUND ART

Soft X-ray sources of high intensity are applied in many fields, for instance surface physics, materials testing, crystal analysis, atomic physics, lithography and microscopy. Conventional soft X-ray sources, which utilise an electron beam towards an anode, generate a relatively low X-ray intensity. Large facilities, such as synchrotron light sources, produce a high average power. However, there are many applications that require compact, small-scale systems which produce a relatively high average power. Compact and more inexpensive systems yield better accessibility to the applied user and thus are of potentially greater value to science and society. An example of an application of particular importance is X-ray lithography.

Ever since the 1960s, the size of the structures that constitute the basis of integrated electronic circuits has decreased continuously. The advantage thereof is faster and more complicated circuits needing less power. At present, photolithography is used to industrially produce such circuits having a line width of about 0.35 $\mu$m. This technique can be expected to be applicable down to about 0.18 $\mu$m. In order to further reduce the line width, other methods will probably be necessary, of which X-ray lithography is a potentially interesting candidate. X-ray lithography can be implemented in two ways: Projection lithography, where use. is made of a reducing extreme ultraviolet (EUV) objective system in the wavelength range around 10–20 nm (see for instance Extreme Ultraviolet Lithography, Eds. Zernike and Attwood, Optical Soc. America Vol. 23 [Washington, D.C., 1994]) and proximity lithography, which is carried out in the wavelength range 0.8–1.7 nm (see for instance Maldonado, X-ray Lithography, J. Electronic Materials 19, 699 [1990]). The present invention relates to a new type of X-ray source, whose immediate field of application is proximity lithography. However, the invention can also be used in other wavelength ranges and fields of applications, such as EUV lithography, microscopy, materials science.

Laser-produced plasma (LPP) is an attractive compact soft X-ray source owing to its small size, high luminous intensity and great spatial stability. Here a target is illuminated by a pulsed laser beam, thereby to form an X-ray-emitting plasma. However, LPP which uses conventional solid targets suffers from serious drawbacks, inter alia, emission of small particles, atoms and ions (debris) which coat and destroy, for example, sensitive X-ray optical systems or lithographic masks arranged close to the plasma. This technique is disclosed in, for instance, WO94/26080.

This drawback can be eliminated by using small and spatially well-defined liquid droplets as target and irradiating them with a pulsed laser beam as disclosed by Rymell and Hertz, Opt. Commun. 103, 105 (1993). According to this publication, the droplets are generated by forming a jet of liquid by urging the pressurised liquid through a small nozzle, which is vibrated piezoelectrically. This droplet-generating method is described in e.g. U.S. Pat. No. 3,416,153 and in Heinzl and Hertz, Advances in Electronics and Electron Physics 65, 91 (1985). This results in very small and spatially well-defined droplets. In addition to eliminating debris, this compact X-ray source gives an excellent geometric access, a possibility of long-term operation without interruption since new target material is continuously supplied, and a possibility of a high average X-ray power by using lasers having a high repetition rate. A similar technique is disclosed by, for instance, Hertz et al, in Applications of Laser Plasma Radiation II, M. C. Richardsson, Ed., SPIE Vol. 2523 (1995), pp 88–93; EP-A-0 186 491; Rymell et al, Appl. Phys. Lett. 66, 20 (1995); Rymell et al, Appl. Phys. Lett 66, 2625 (1995); and U.S. Pat. No. 5,459,771.

A drawback of this technique is however that all liquids cannot form sufficiently spatially stable microscopic droplets, and therefore it will be difficult to guide the laser light so as to irradiate the microscopic droplets. Moreover, there are also for suitable liquids slow drifts in droplet position relative to the focus of the laser beam, which results in the synchronization of the laser plasma production requiring temporal adjustment.

SUMMARY OF THE INVENTION

It is therefore an object of the present invention to provide a method and an apparatus for stable and uncomplicated X-ray or EUV generation via laser plasma emission from a target in a chamber. The inventive apparatus should be compact, inexpensive and generate a relatively high average power as stated above and have a minimum production of debris. A further object is to provide a method and an apparatus which produces X-radiation which is suitable for proximity lithography. One more object of the invention is to permit use of the apparatus and the method in microscopy, lithography and materials science.

These and other objects, which will be apparent from the following specification, are wholly or partially achieved by the method according to claim 1 and the apparatus according to claim 6. The subclaims define preferred embodiments.

According to the invention, the laser beam is focused on a spatially continuous portion of the jet generated from a liquid. This can be achieved, for instance, by generating the jet as a spatially completely continuous jet of liquid, and by focusing the laser light on the actual jet before this spontaneously breaks up into droplets. Alternatively, it is conceivable that the jet is generated in the form of a pulsed or semicontinuous jet of liquid consisting of separate, spatially continuous portions each having a length that significantly exceeds the diameter.

By producing a laser plasma in a spatially continuous portion of the jet, new liquids can be used as target. Furthermore, the stability is improved since slow drifts no longer affect the X-ray emission. It is also important that the handling is simplified to a considerable extent by the laser not needing temporal synchronization with the drop formation in order to irradiate a separate droplet. Thus, in many cases a less advanced laser can be employed. These advantages are obtained while retaining many of the advantages of droplet-shaped liquid target, as discussed by way of introduction, for example, a great reduction of debris, excellent geometric access, a possibility of long-term operation without interruption by providing new target material continuously through the jet of liquid, low cost for target material, and the possibility of using lasers of high repetition rates, which increases the average X-ray power.

The present invention is based on the need of compact and intensive X-ray or EUV sources for, inter alia, lithography, microscopy and materials science. Wavelength ranges of particular interest for such applications are 0.8–1.7 nm (lithography), 2.3–4.4 nm (microscopy) and 0.1–20 nm (materials science, for instance photoelectron spectroscopy or X-ray fluorescence, or EUV lithography). Such X-ray radiation can be produced with laser-produced plasma. The generation of such short wavelength ranges with high conversion efficiency requires laser intensities around $10^{13}$–$10^{15}$ W/cm$^2$. In order to achieve such intensities with compact laser systems, focusing to about 10–100 $\mu$m in diameter is required. Thus, a target can be made microscopic, provided that it is spatially stable. The small dimensions contribute to effective utilization of the target material, which, among other things, results in a drastic reduction of debris.

As a special application to the above-mentioned X-ray source, the present invention states proximity lithography which requires irradiation in the wavelength range 0.8–1.7 nm. Emission concentrated to this wavelength range from microscopic targets generated by a liquid has not been obtained previously. According to the invention, e.g. fluorine-containing liquids can be used. By irradiating a microscopic jet of liquid with pulsed laser radiation, emission from ionized fluorine (F VIII and F IX) of high X-ray intensity in the wavelength range 1.2–1.7 nm is generated. This radiation can be used for lithography of a structure below 100 nm by means of suitable lithographic masks, X-ray filters etc.

By using the above-mentioned liquids and also other liquids, suitable X-ray wavelengths can be generated for a number of different applications using the described invention. Examples of such applications are X-ray microscopy, materials science (e.g. photoelectron microscopy and X-ray fluorescence), EUV projection lithography or crystal analysis. It should be emphasized that the liquid used in the invention can either be a medium which is normally in a liquid state at the temperature prevailing at the generation of the jet of liquid, or solutions comprising substances which are normally not in a liquid state and a suitable carrier liquid.

BRIEF DESCRIPTION OF THE DRAWINGS

The invention will now be described for the purpose of exemplification with reference to the accompanying drawings, which illustrate a currently preferred embodiment and in which.

DESCRIPTION OF THE PREFERRED EMBODIMENTS

Figure 1:
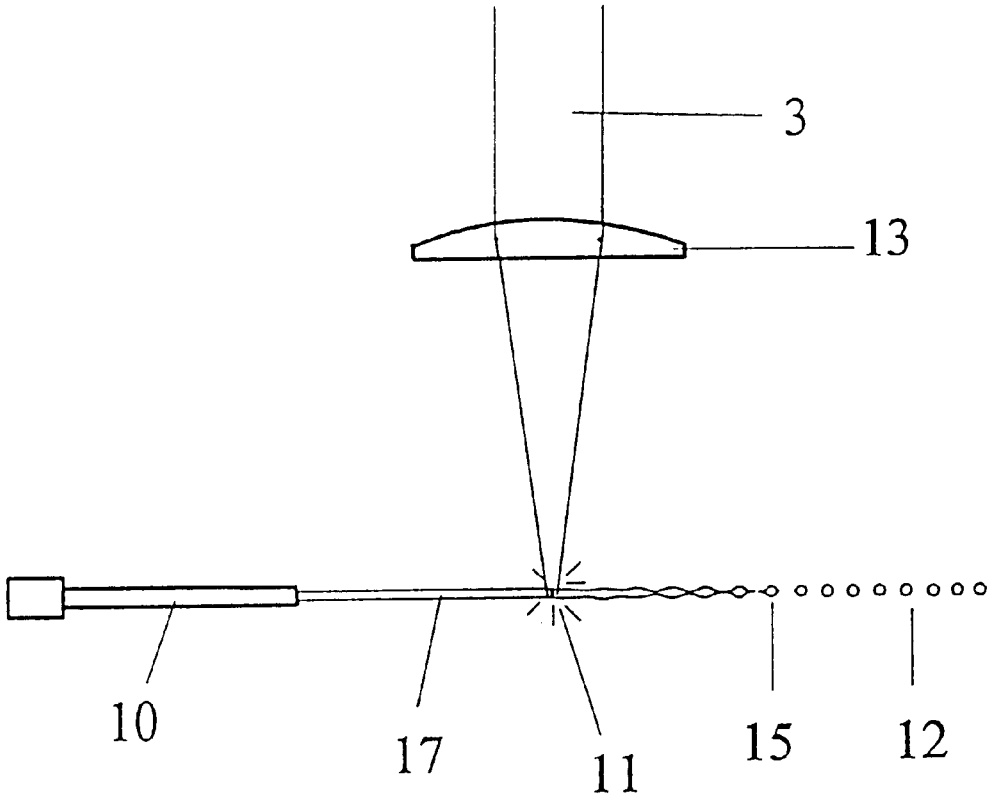
FIG. 1 is a schematic view of an inventive apparatus for generating X-ray or EUV radiation by generating a plasma in a thin jet of liquid before this is broken up into droplets.
Figure 2:
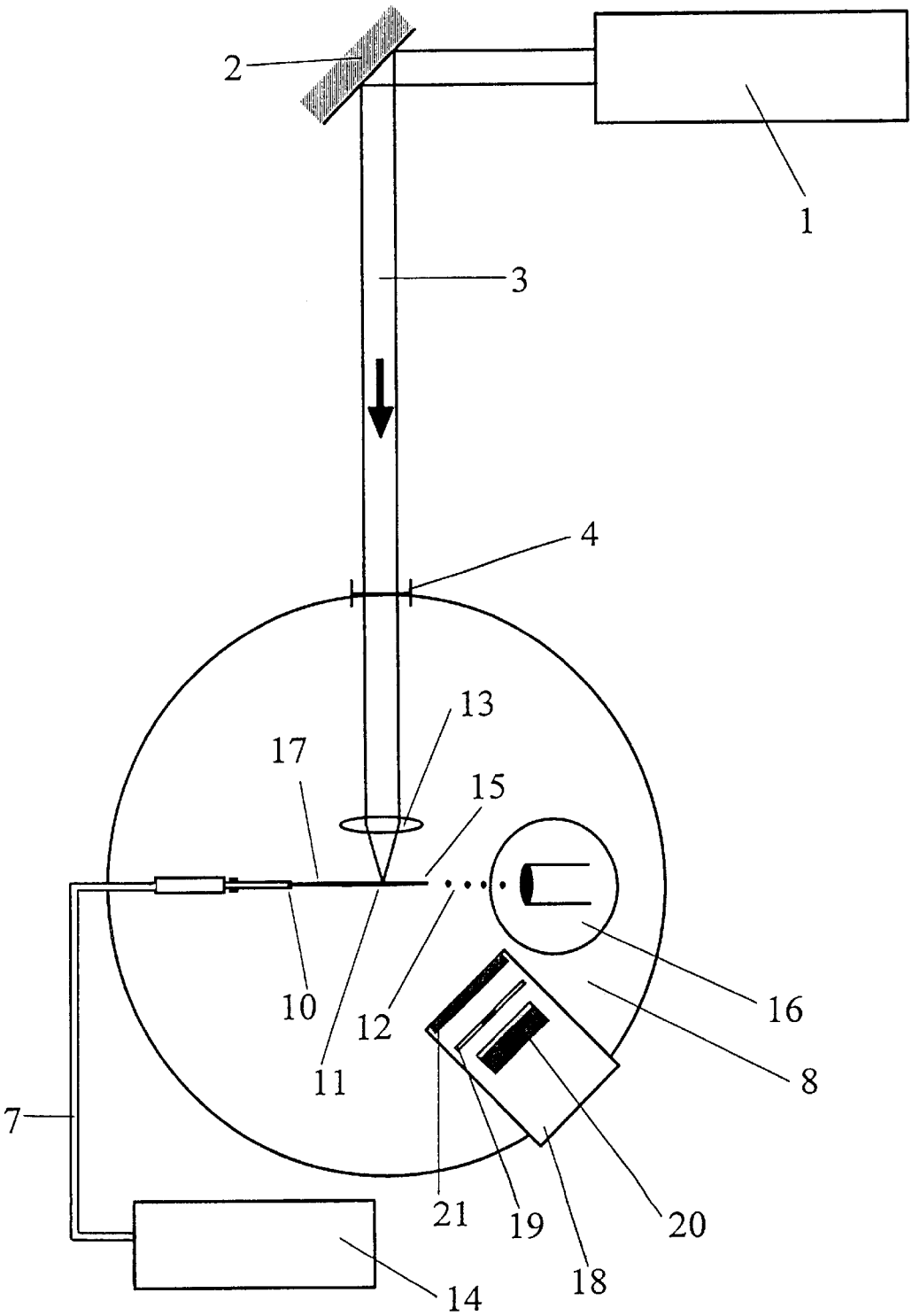
FIG. 2 illustrates an embodiment of an inventive apparatus for X-ray generation, especially for proximity lithography.

The method and the apparatus according to the invention are basically illustrated in FIGS. 1 and 2. One or more pulsed laser beams 3 are focused from one or more directions on a jet 17 of liquid, which serves as target. For reasons of clarity, only one laser beam is shown in FIGS. 1 and 2. The formed plasma emits the desired X-ray radiation. The actual production of X-rays usually takes place in vacuum, thereby preventing emitted soft X-ray radiation from being absorbed. For certain X-ray or EUV wavelengths, the laser plasma production may be operated in a gaseous environment. Vacuum is preferable to prevent laser-induced breakdowns in front of the jet 17 of liquid.

For the forming of microscopic and spatially stable jets of liquid in vacuum, use is here made of a spatially continuous jet 17 of liquid, which forms in a vacuum chamber 8 as is evident from FIG. 2. The liquid 7 is urged under high pressure (usually 5–100 atmospheres) from a pump or pressure vessel 14 through a small nozzle 10, the diameter of which usually is smaller than about 100 $\mu$m and typically one or two up to a few tens of micrometers. This results in a stable microscopic jet 17 of liquid of essentially the same diameter as the nozzle 10 and a speed of about 10–100 m/s. The jet 17 of liquid propagates in a given direction to a drop-formation point 15, at which it spontaneously separates into droplets 12. The distance to the drop-formation point 15 is determined essentially by the hydrodynamic properties of the liquid 7, the dimensions of the nozzle 10 and the speed of the liquid 7, see for instance Heinzl and Hertz, Advances in Electronics and Electron Physics 65, 91 (1985). The drop formation frequency is partly random. For some low viscous liquids, turbulence may imply that no stable jet 17 of liquid is obtained, while for certain liquids of low surface tension, the drop-formation point 15 can be located far away from the nozzle 10.

When the liquid 7 leaves the nozzle 10, it is cooled by evaporation. It is conceivable that the jet 17 may freeze, such that no droplets 12 are formed. The focused laser beam 11 may, within the scope of the invention, be focused on a spatially continuous portion of the thus frozen jet. Also in this case, the laser light is focused in a point on the jet between the nozzle 10 and a fictitious drop-formation point.

Existing compact laser systems, which give sufficient pulse energy, currently have repetition rates which usually do not exceed 100–1000 Hz. The laser beam 3 is focused to diameters around 10–100 $\mu$m. Given the speed of the jet 17 of liquid, the main part of the liquid 7 will thus not be used for laser plasma production, which for many liquids results in an increase of pressure in the vacuum chamber 8 owing to evaporation. The problem can be solved, for instance, by a cold trap 16 catching the nonused liquid, as appears from FIG. 2. Alternatively (not shown), the nozzle 10 can be positioned outside the main vacuum chamber 8 and inject the liquid through a very small aperture. In that case, a mechanical chopper or electric deflection means outside the main vacuum chamber 8 can be used to supply merely the desired amount of liquid to the main vacuum chamber 8. For liquids having low evaporation, it may be sufficient to increase the pump capacity.

The use of continuously operating jets 17 of liquid of the type described above results in sufficient spatial stability (±a few micrometers) to permit laser plasma production with a laser beam 3 focused to approximately the same size as the diameter of the jet 17 of liquid. Semicontinuous or pulsed jets of liquid may, within the scope of the invention, be applicable in special cases. This type of jets consists of separate, spatially continuous portions, which are generated by ejecting the liquid through the nozzle during short periods of time only. In contrast to droplets, the spatially continuous portions of the semicontinuous jets, however, have a length which is considerably greater than the diameter.

In the embodiment shown in FIG. 2, the laser plasma is produced by focusing a pulsed laser 1, optionally via one or more mirrors 2, by means of a lens 13 or some other optical focusing means on a spatially continuous portion of the jet of liquid, more specifically on a point 11 in the jet 17 of liquid between the nozzle 10 and the drop-formation point 15. It is preferred that the distance from the nozzle 10 to the drop-formation point 15 is sufficiently long (in the order of a millimeter), such that the produced laser plasma in the focus 11 can be positioned at a given distance from the nozzle 10, such that the nozzle is not damaged by the plasma. For X-ray emission in the wavelength range around 1–5 nm, a laser intensity of about $10^{13}$–$10^{15}$ W/cm$^2$ is required. For example, such intensities can easily be achieved by focusing laser pulses having a pulse energy in the order of 100 mJ and a pulse duration in the order of 100 ps to a focus of about 10 $\mu$m. Such lasers in the visible, ultraviolet and near infrared wavelength range are commercially available with repetition rates of 10–20 Hz, and systems having a higher repetition rate are being developed at present. The short pulse duration is important for obtaining a high intensity, while the pulse energy and, thus, the size of the laser are kept small.

Moreover, a short pulse causes a reduction of the size of the formed plasma. Longer pulses result in larger plasma owing to the expansion of the plasma, which normally is about $1–3\cdot10^7$ cm/s. If a larger plasma is acceptable, a higher total X-ray flux can be obtained by using a greater diameter of the jet of liquid and a slightly longer pulse duration in combination with higher pulse energy. If longer wavelengths are desired, the laser pulse duration should be increased to give a lower maximum power. By using, for instance, some hundreds of mJ/pulse and a pulse duration longer than a nanosecond, the emission in the wavelength range 10–30 nm is increased at the expense of the emission in the 0.5–5 nm range. This is important to EUV projection lithography.

The above-mentioned method of generating X-ray radiation can be used for, inter alia, proximity lithography. An apparatus for this purpose is shown in FIG. 2. Here use is made of liquids as target. It has been found that fluorine-containing liquids, for instance liquid $C_mF_n$, where n can be 5–10 and m 10–20, result in a strong X-ray emission in the wavelength range 1.2–1.7 nm. The hydrodynamic properties of many such liquids require that, according to the invention, use is made of a spatially continuous portion of the jet of liquid as target. An exposure station 18 is positioned at a certain distance from the laser plasma in the focus 11 of the laser. The exposure station 18 comprises e.g. a mask 19 and a resist-coated substrate 20. Thin X-ray filters 21 filter the emitted radiation such that only radiation in the desired wavelength range reaches the mask 19 and the substrate 20. By using a microscopic target of liquid, the production of debris will be very low, which means that the distance between the exposure station and the laser plasma can be made small. If the further requirements in respect of lithography permit so, the distance can be down to a few centimeters. This reduces the exposure time. Alternatively, an X-ray collimator can be employed.

By using other liquids than those discussed above, emission can be obtained in new X-ray wavelength ranges. Laser plasma in a jet of liquid of e.g. ethanol or ammonia generates X-ray emission in the wavelength range 2.3–4.4 nm, which is suitable for X-ray microscopy, as is known for droplets from Rymell and Hertz, Opt. Commun 103, 105 (1993), and Rymell, Berglund and Hertz, Appl. Phys. Lett. 66, 2625 (1995). Use is here made of the emission from carbon and nitrogen ions. Water or aqueous mixtures containing much oxygen can be combined with lasers having lower pulse peak power for generating EUV radiation suitable for projection lithography in the wavelength range 10–20 nm, as is known for droplets from H. M. Hertz, L. Rymell, M. Berglund and L. Malmqvist in Applications of Laser Plasma Radiation II, M. C. Richardsson, Ed., SPIE Vol. 2523 (Soc. Photo-Optical Instrum. Engineers, Bellingham, Wash., 1995, pp 88–93). Liquids containing heavier atoms result in emission at shorter wavelengths, which is of interest for e.g. photoelectron spectroscopy and X-ray fluorescence in materials science. Further shorter wavelengths can be obtained if higher laser intensities are used, which may be of interest for X-ray crystallography. Moreover, substances which are normally not in a liquid state, can be dissolved in a suitable carrier liquid and thus be used for X-ray production with laser plasma in jets of liquid.

We claim:

1. A method for generating X-ray or EUV radiation via laser plasma emission, comprising: generating at least one target; and focusing at least one pulsed laser beam on the target, wherein the target is generated by urging a liquid through an orifice to form a jet of the liquid, and that the laser beam is focused on a spatially continuous portion of the jet.

2. The method as claimed in claim 1, wherein the jet is generated by urging a liquid under pressure through a nozzle, such that the jet propagates towards a drop-formation point, at which the jet separates into droplets, and wherein the laser beam is focused on a spatially continuous portion of the jet between the nozzle and the drop-formation point.

3. The method as claimed in claim 2, wherein the laser beam is focused a distance in the order of a millimeter from the nozzle.

4. The method as claimed in claim 1, wherein the jet is generated having a diameter of about 1–100 $\mu$m.

5. The method as claimed in claim 1, wherein a fluorine-containing liquid is used for generation of the jet for the purpose of producing X-ray emission in the wavelength range 0.8–2 nm for contact lithography.

6. An apparatus for generating X-ray or EUV radiation via laser plasma emission, comprising means for generating at least one laser beam, means for generating at least one target; and means for focusing the laser beam on the target, wherein the target-generating means includes an orifice through which a liquid is urged to generate a jet of the liquid, and the focusing means is arranged to focus the laser beam on a spatially continuous portion of the jet.

7. The apparatus as claimed in claim 6, wherein the target-generating means includes a pump for urging under pressure a liquid through a nozzle for generating the jet such that the jet propagates towards a drop-formation point, the jet separating into droplets at the drop-formation point, and wherein the focusing means is arranged to focus the laser beam on a spatially continuous portion of the jet between the nozzle and the drop-formation point.

8. The apparatus as claimed in claim 7, wherein the focusing means is arranged to focus the laser beam a distance in the order of a millimeter from the nozzle.

9. The apparatus as claimed in claim 6, wherein the target-generating means is arranged to generate the jet having a diameter of about 1–100 $\mu$m.

10. The apparatus as claimed in claim 6, wherein the liquid is a fluorine-containing liquid for producing X-ray emission in the wavelength range 0.8–2 nm for proximity lithography, the apparatus further comprising an exposure station proximate a point at which the laser beam is focused on the jet.

11. The apparatus as claimed in claim 6, wherein the emitted radiation is used for X-ray microscopy.

12. The apparatus as claimed in claim 6, wherein the emitted radiation is used for proximity lithography.

13. The apparatus as claimed in claim 6, wherein the emitted radiation is used for EUV projection lithography.

14. The apparatus as claimed in claim 6, wherein the emitted radiation is used for photoelectron spectroscopy.

15. The apparatus as claimed in claim 6, wherein the emitted radiation is used for X-ray fluorescence.

16. The method as claimed in claim 2, wherein the jet is generated having a diameter of about 1–100 $\mu$m.

17. The method as claimed in claim 3, wherein the jet is generated having a diameter of about 1–100 $\mu$m.

18. The method as claimed in claim 2, wherein a fluorine-containing liquid is used for generation of the jet for the purpose of producing X-ray emission in the wavelength range 0.8–2 nm for contact lithography.

19. The method as claimed in claim 3, wherein a fluorine-containing liquid is used for generation of the jet for the purpose of producing X-ray emission in the wavelength range 0.8–2 nm for contact lithography.

20. The method as claimed in claim 4, wherein a fluorine-containing liquid is used for generation of the jet for the purpose of producing X-ray emission in the wavelength range 0.8–2 nm for contact lithography.

* * * * *